US010183792B2

(12) United States Patent
Brown et al.

(10) Patent No.: US 10,183,792 B2
(45) Date of Patent: Jan. 22, 2019

(54) CONTAINER

(71) Applicant: Conopco, Inc., Englewood Cliffs, NJ (US)

(72) Inventors: Oliver Benjamin Brown, Warwick (GB); Christopher John Jones, Tewkesbury (GB); David Moore, Leicester (GB); Graham Paul Randall, Wirral (GB)

(73) Assignee: CONOPCO, INC., Englewood Cliffs, NJ (US)

( * ) Notice: Subject to any disclaimer, the term of this patent is extended or adjusted under 35 U.S.C. 154(b) by 70 days.

(21) Appl. No.: 15/319,219

(22) PCT Filed: Jun. 26, 2015

(86) PCT No.: PCT/EP2015/064598
§ 371 (c)(1),
(2) Date: Dec. 15, 2016

(87) PCT Pub. No.: WO2016/001104
PCT Pub. Date: Jan. 7, 2016

(65) Prior Publication Data

US 2017/0152083 A1 Jun. 1, 2017

(30) Foreign Application Priority Data

Jul. 2, 2014 (EP) ..... 14175358

(51) Int. Cl.
*B65D 51/16* (2006.01)
*B65D 51/18* (2006.01)
*B65D 43/02* (2006.01)

(52) U.S. Cl.
CPC ..... *B65D 51/1644* (2013.01); *B65D 43/0231* (2013.01); *B65D 51/1661* (2013.01); *B65D 51/1666* (2013.01)

(58) Field of Classification Search
CPC ..... B65D 51/1644; B65D 51/1661; B65D 51/1683; B65D 43/0231; B65D 77/225;
(Continued)

(56) References Cited

U.S. PATENT DOCUMENTS 340,650 A * 4/1886 Young ..... B60K 15/0406 220/303
1,941,048 A * 12/1933 Punte ..... B65D 51/1644 137/516.13

(Continued)

FOREIGN PATENT DOCUMENTS

CN 87203820 4/1988
CN 202046549 11/2011

(Continued)

OTHER PUBLICATIONS

Search Report and Written Opinion in EP14175358 dated Jan. 26, 2015. pp. 1 to 5.

(Continued)

*Primary Examiner* — J. Gregory Pickett
*Assistant Examiner* — Gideon Weinerth
(74) *Attorney, Agent, or Firm* — Foley & Lardner LLP

(57) ABSTRACT

The invention provides a container (10) for the packaging of a fluent product (P) which off-gases, the container comprising: a container body (11) for receiving and storing product and a removable lid (12) for closing the container body; in which the lid is provided with a venting assembly (20, 23*a*, 23*b*, 24) extending into the container body; in which the venting assembly has a closed position which is effective to close the container body and a venting position permitting the venting of gas from the container body; whereby, when the container body is partially filled with a fluent product which off-gases, the venting assembly moves to the venting position in response to excessive pressure from accumulated (Continued)

gas, and reverts to the closed position upon release of the excessive pressure, thus effecting periodic venting of the container body; and whereby the spatial arrangement of the venting assembly within the container body provides for venting of the container body independently of the orientation of the container, while retaining the product within the container body. The container is especially suitable for the packaging of viscous or semisolid products which incorporate an oxidizing agent, such as creams or gels for the bleaching or coloring of hair.

3 Claims, 2 Drawing Sheets

(58) Field of Classification Search
CPC .... B65D 51/1666; B65D 53/00; B65D 47/32; F16K 15/148; F16K 7/07; F16K 7/075; F16K 7/17; F16K 7/12
USPC ..... 220/203.01, 203.29, 203.27, 203.18, 220/302.11, 303, 203.11; 215/311, 261, 215/308, 349, 322, 260, 270; 137/859, 137/843, 845, 846, 847; 426/118; 383/103
See application file for complete search history.

(56) References Cited

U.S. PATENT DOCUMENTS 1,950,327 A * 3/1934 Punte ..... B65D 51/1644 220/203.18
2,162,455 A * 6/1939 Hoge ..... B65D 51/165 137/859
2,173,571 A * 9/1939 Jesnig ..... B65D 51/1644 137/854
2,429,984 A * 11/1947 Berglund ..... B65D 51/1644 137/859
2,461,620 A * 2/1949 Wright ..... B65D 47/283 215/311
2,582,489 A * 1/1952 Krueger ..... B65D 51/00 215/262
2,734,651 A * 2/1956 Lindstrom ..... B65D 41/0435 215/329
3,174,641 A * 3/1965 Kitterman ..... B65D 41/045 215/260
3,448,882 A 6/1969 Roy
3,471,051 A 10/1969 Cistone
3,521,784 A 7/1970 Gaines
3,549,040 A * 12/1970 Milton ..... B65D 51/1644 220/203.11
3,807,608 A * 4/1974 Nilsson ..... B65D 47/2062 222/521
3,976,216 A * 8/1976 Lambert ..... B65D 51/1644 215/260
4,210,255 A * 7/1980 Pan ..... B65D 51/1644 215/260
4,722,450 A 2/1988 Mario
4,799,598 A * 1/1989 McFadyen ..... B65D 50/041 215/260
4,828,129 A * 5/1989 Jonkers ..... B65D 51/1644 215/260
4,848,749 A * 7/1989 Schneider ..... B01F 3/04269 261/62
5,152,419 A * 10/1992 Yanagi ..... B60K 15/0406 215/307
5,339,977 A 8/1994 Schormair
5,407,087 A 4/1995 Giblin
5,460,282 A 10/1995 Giblin
5,597,096 A * 1/1997 Jeppesen ..... B65D 43/0212 215/317
5,705,063 A * 1/1998 Lee ..... B01F 3/04269 210/220
6,202,871 B1 * 3/2001 Kelly ..... B65D 41/3423 215/307
6,662,827 B1 * 12/2003 Clougherty ..... B65D 77/225 137/859
6,976,669 B2 * 12/2005 Van Zijll Langhout ..... B65D 47/2025 141/65
8,453,870 B2 * 6/2013 Berg ..... A47G 19/2272 215/311
8,485,398 B2 * 7/2013 Kneer ..... B65D 47/18 137/852
9,517,864 B2 * 12/2016 Haintze ..... B65D 53/04
9,834,345 B2 * 12/2017 Wieder ..... A47G 19/2266
2002/0056695 A1 * 5/2002 Boulange ..... B65D 51/1616 215/261
2002/0066714 A1 6/2002 Mainquist
2002/0066716 A1 6/2002 Mainquist
2006/0169694 A1 * 8/2006 Kemper ..... A47G 19/2272 220/303
2007/0007231 A1 * 1/2007 Naesje ..... B65D 47/2081 215/311
2008/0277400 A1 * 11/2008 Welsh ..... B65D 77/225 220/592.2
2009/0294443 A1 * 12/2009 Lau ..... B65D 51/1683 220/202
2010/0133709 A1 * 6/2010 Hu ..... B01F 3/04269 261/122.2
2010/0155401 A1 * 6/2010 Cook ..... B65D 47/2075 220/203.01
2015/0060459 A1 * 3/2015 Wu ..... B65D 43/0212 220/361
2015/0316161 A1 * 11/2015 Buckingham ..... B65D 77/225 137/843
2017/0152083 A1 * 6/2017 Brown ..... B65D 51/1644

FOREIGN PATENT DOCUMENTS

DE 7225421 3/1973
DE 2233462 1/1974
DE 8608897 9/1986
DE 4038870 6/1992
DE 20302225 4/2003
EP 241780 10/1987
FR 2998456 5/2014
GB 1084564 9/1967
GB 1126258 9/1968
GB 2032892 5/1980
JP 2002114253 4/2002
KR 20130062178 6/2013
WO WO9422735 10/1994
WO WO2012053734 4/2012
WO WO2014082930 6/2014

OTHER PUBLICATIONS

Search Report and Written Opinion in PCTEP2015064598 dated Sep. 8, 2015. pp. 6 to 15.

* cited by examiner

CONTAINER

FIELD OF THE INVENTION

This invention relates to containers and more particularly to containers for the packaging of fluent products which off-gas.

BACKGROUND OF THE INVENTION AND PRIOR ART

Household or industrial products which contain active chemicals and ingredients often release gases when packaged in containers. As a result, pressure differences may build up between the inside of a closed container and the ambient pressure. If these pressure differences are not adequately resolved, then over time the container may swell, distort or even rupture and leak its contents. Thin-walled, partially flexible containers are particularly sensitive to the problem. Fluctuations in temperature and altitude during shipping or storage may also exacerbate the problem.

One approach to the problem of pressure build up involves the incorporation of selective barrier materials which are impermeable to liquids, but permeable to gases. GB 1 464 344 describes a self-venting closure comprising a gas-permeable membrane covering an orifice to the exterior. EP 593 840 discloses a container made of a thermoplastic material comprising a network of microchannels. This network of microchannels is permeable to gases, but not to liquids.

One drawback of the above approach is that the membranes or microchannels may lose at least part of their gas-permeability if they come into contact with liquid product inside the container. Furthermore, liquid products which are viscous or which have some affinity for the membranes or microchannels may adhere to them or block them following such contact instead of draining away back into the container package. Therefore the container loses venting capacity. There are many instances which can lead to such contact, such as the product agitation which normally occurs during shipment and transportation, or tilting or inversion of the container itself during storage.

It is an object of the present invention to provide an improved container for the packaging of fluent products which off-gas, which provides for venting of the container body independently of the orientation of the container, whilst retaining the product within the container body.

Another object of the invention is to provide an improved container for the packaging of viscous or semisolid products (such as gels, pastes, creams or lotions) which off-gas.

SUMMARY OF THE INVENTION

The present invention provides a container for the packaging of a fluent product which off-gases, the container comprising:

a container body for receiving and storing product and a removable lid for closing the container body;

in which the lid is provided with a venting assembly extending into the container body;

in which the venting assembly has a closed position which is effective to close the container body and a venting position permitting the venting of gas from the container body;

whereby, when the container body is partially filled with a fluent product which off-gases, the venting assembly moves to the venting position in response to excessive pressure from accumulated gas, and reverts to the closed position upon release of the excessive pressure, thus effecting periodic venting of the container body;

and whereby the spatial arrangement of the venting assembly within the container body provides for venting of the container body independently of the orientation of the container, whilst retaining the product within the container body.

In a typical container according to the invention, the container body comprises a container base and a container wall extending from the base, the wall having an upper portion defining the mouth of the container body and bearing a threaded surface;

the removable lid comprises a top portion and a depending skirt portion; the depending skirt portion bearing a threaded surface configured for engagement with a corresponding threaded surface of the mouth of the container body, and the venting assembly comprises a hollow venting tube provided on an inner surface of the top portion of the lid and configured such that it extends into the interior of the container body when then lid is engaged with the body; the hollow venting tube having an upper end in sealed contact with the inner surface of the top portion of the lid and a lower end bearing one or more apertures for the intake of accumulated gas; and a venting tube liner of resilient flexible material having an disc shaped portion with a circumferential edge adapted for engagement with an inner surface of the lid and at least one tubular portion extending from the disc shaped portion and configured such that it shrouds the hollow venting tube when the venting tube liner is engaged with the lid.

The venting tube liner as defined above is movable from a closed position, covering the one or more apertures in the hollow venting tube and effective to close the container body, to a venting position exposing the one or more apertures in the hollow venting tube; and permitting venting of gas from the container body.

When the container body is partially filled with a fluent product which off-gases, the venting tube liner moves to the venting position in response to excessive pressure from accumulated gas, and reverts to the closed position upon release of the excessive pressure, thus effecting periodic venting of the container body.

The spatial arrangement of the hollow venting tube within the container body provides for venting of the container body independently of the orientation of the container, whilst retaining the product within the container body.

In a typical container according to the invention, the container wall surrounds and encloses an interior volume of the container body, and includes a peripheral section disposed at least a minimum radius r from a first axis within the interior volume; and a pair of end sections disposed generally transverse to the first axis and joined peripherally to the peripheral sections. The venting assembly extends along the first axis with the end sections of the container wall each being separated from the one or more apertures of the hollow venting tube along the first axis by a distance h; such that when the interior volume is partially filled with product, the product has a depth of less than h when the first axis is disposed vertically and less than r when the first axis is disposed horizontally.

In a preferred container according to the invention, the container wall surrounds and encloses an interior volume of the container body having a geometric centre that is generally equidistant from opposite points of the container wall, and the venting assembly is disposed centrally in three dimensions within the interior volume; such that when the interior volume is partially filled with product, the one or more apertures of the hollow venting tube remain in the head space of the product regardless of the orientation of the container.

Typically, in a partially filled container according to the present invention, product occupies a volume ranging from 0.1 v to 0.75 v, where v is the interior volume of the container body. Preferably product occupies a volume of from 0.15 v to 0.50 v, more preferably from 0.2 v to 0.4 v.

In a preferred form of container according to the invention, the ratio of the height of the container to the largest inner diameter of the mouth of the container body is 3:1 or less. More preferably the ratio is 1:1 or less, and most preferably the ratio ranges from 4:5 to 1:2.

Preferably, the container base has a flat or slightly concave surface to allow a stable position on a flat surface.

The height of the container is the vertical distance between the flat surface of the container base, or the edge of the concave surface of the container base, to the mouth of the container body.

Preferably the height of the container is from 45 to 65 mm and more preferably from 50 to 60 mm.

A particularly preferred form of container according to the invention has a generally cylindrical shape and is configured such that the flat surface of the container base, or the edge of the concave surface of the container base, is located parallel to the surface which is spanned by the mouth of the container body.

The mouth of the container body is preferably rounded in shape, such as annular or elliptical, in order to facilitate handling and/or product removal by the consumer.

The largest inner diameter of the mouth of the container body (generally the diameter of an annular mouth or the length of the major axis of an ellipsoidal mouth) is typically at least 50 mm, preferably from 60 to 80 mm, more preferably from 65 to 75 mm.

The mouth of the container body typically has a surface area of at least 50% of the surface area of the container base, preferably at least 80% of the surface area of the container base. More preferably the mouth of the container body has a surface area of from 85% to 115% of the surface area of the container base.

Preferably the container has an interior volume from 100 to 300 ml, more preferably from 180 to 260 ml.

Typically the container body, lid and venting assembly are each formed from plastics materials. Preferably the container body, lid and venting assembly are each formed from moulded thermoplastic materials such as polyurethanes, polyamides, polyolefins (for example, polyethylene and polypropylene), polyesters, or combinations thereof.

The term "fluent product" in the context of this invention generally means a material other than a gas which is capable of flowing without retaining its physical shape and accordingly excludes firm solids which retain their physical shape when subjected to mild pressure.

The container of the invention is especially suitable for the packaging of viscous or semisolid products (such as gels, pastes, creams or lotions) which off-gas.

A preferred type of product for packaging in a container according to the invention is a viscous or semisolid product (such as a gel, paste, cream or lotion) which incorporates an oxidizing agent.

Specific examples of such products include creams or gels which are used in the cosmetic field on hair and skin.

Preferred examples of such products include creams or gels for the bleaching or colouring of hair.

Particularly preferred examples of such products include cream or gel colour developers for use in permanent hair colorants. The term "permanent hair colorant" generally refers to hair colouring agents in which oxidative dye precursors diffuse into the hair through the cuticle and into the cortex, where they can then undergo oxidative coupling reactions in the presence of suitable oxidizing agents to form the end dye molecules which produce colour inside the hair.

Permanent hair colorants are typically formulated in two parts: one part containing the hair colorant, which incorporates oxidative dye precursors; and the other part containing the colour developer, which incorporates the oxidizing agent. In order to colour the hair, the hair colorant and colour developer are mixed together, usually shortly before use. On the hair, the mixture forms a stable formulation with enough consistency and body to remain on the hair without dripping or running during the colouring period. The oxidative dye precursors diffuse into the hair together with the oxidizing agent from the colour developer. The dyes form within the hair fibre. Being large molecules, they remain in the hair and do not readily wash out with ordinary shampoos. At the end of the colouring period, (generally about 5 to 45 minutes and preferably about 10 to 30 minutes), the formulation is washed from the hair with a plain water rinse. If necessary, the hair is washed with a shampoo and rinsed, for example with water or a weakly acidic solution, such as a citric acid or tartaric acid solution, and dried. Optionally, a separate conditioning product may also be applied. Preferably, such a separate conditioning product is applied after rinsing A cream or gel colour developer as described above will generally comprise an oxidizing agent in an amount sufficient to cause formation of dye chromophores from the oxidative dye precursors. Typically, the amount of oxidizing agent ranges from about 1 to about 20 wt %, preferably from about 3 to about 15 wt %, more preferably from about 6 to about 12 wt %, by weight based on the total weight of the composition. Preferred oxidizing agents in this context are peroxygen materials capable of yielding hydrogen peroxide in an aqueous medium such as: hydrogen peroxide; inorganic alkali metal peroxides (e.g. sodium periodate and sodium peroxide); organic peroxides (e.g. urea peroxide, melamine peroxide); inorganic perhydrate salt bleaching compounds (e.g. alkali metal, preferably sodium, salts of perborates, percarbonates, perphosphates, persilicates, and persulphates, which may be incorporated as monohydrates, tetrahydrates or the like); alkali metal bromates; enzymes; and mixtures thereof. Preferred is hydrogen peroxide.

A cream or gel colour developer as described above will also typically comprise one or more thickeners in an amount sufficient to provide the composition with a viscosity of from about 1 Pa·s to 40 Pa·s at 25° C. Suitable thickeners for use in this context may be chosen, for example, from associative thickeners comprising both hydrophilic units and hydrophobic units (e.g. at least one $C_8$ to $C_{30}$ fatty chain); crosslinked acrylic acid homopolymers; crosslinked copolymers of (meth)acrylic acid and of ($C_1$ to $C_6$) alkyl acrylate; nonionic homopolymers and copolymers containing ethylenically unsaturated monomers of ester and amide type; ammonium acrylate homopolymers and copolymers of ammonium acrylate and of acrylamide; polysaccharides; and $C_{10}$ to $C_{24}$ fatty alcohols.

Preferred thickeners in this context are $C_{10}$ to $C_{24}$ fatty alcohols. Preferred fatty alcohols have the formula R—OH, in which R is selected from branched or unbranched alkyl or alkenyl groups having from about 16 to 18 carbon atoms. Examples of such materials include cetyl alcohol, stearyl alcohol and mixtures thereof.

The total quantity of $C_{10}$ to $C_{24}$ fatty alcohols in the colour developer generally ranges from about 0.5 to about 10 wt %, preferably from about 1 to about 7 wt %, more preferably from about 3 to about 5 wt % by total weight $C_{10}$ to $C_{24}$ fatty alcohol(s), based on the total weight of the colour developer Most preferably the colour developer comprises from 3 to 5 wt % $C_{10}$ to $C_{24}$ fatty alcohol(s) selected from cetyl alcohol, stearyl alcohol and mixtures thereof, by weight based on the total weight of the composition.

A preferred ingredient for inclusion in the colour developer is a conditioning polymer containing cationic monomer units. Suitable conditioning polymers in this context include synthetic copolymers containing cationic monomer units. The cationic monomers for use in these copolymers can include dialkylaminoalkyl(meth)acrylamides, trialkylaminoalkyl(meth)acrylamides, dialkylaminoalkyl(meth)acrylates, trialkylaminoalkyl(meth)acrylates, dialkyldiallyl ammonium halides and the like.

Examples of suitable conditioning polymers containing cationic monomer units for use in the invention include copolymers of acrylic acid or methacrylic acid with di ($C_1$-$C_4$ alkyl) diallyl ammonium halides such as in particular dimethyldiallyl ammonium chloride (DMDAAC). The copolymers may also incorporate other polymerisable non-ionic monomers such as acrylic acid esters (preferably $C_1$-$C_4$ esters such as methyl acrylate), acrylamide and the like.

Preferred conditioning polymers containing cationic monomer units for use in the invention are copolymers of DMDAAC and acrylic acid. Particularly preferred are copolymers of DMDAAC and acrylic acid in which the DMDAAC:acrylic acid weight ratio ranges from about 95:5 to about 50:50, ideally from about 95:5 to 65:35, based on total polymer weight.

The conditioning polymers containing cationic monomer units for use in the invention may have a weight average molecular weight (as determined by gel permeation chromatography) ranging from about 5,000 to about 6,000,000, with the preferred molecular weight ranging from about 100,000 to about 5,000,000. A commercially available example of a conditioning polymer containing cationic monomer units for use in the invention is MERQUAT® 280 (ex Lubrizol Corporation). MERQUAT® 280 contains 80:20 (w/w) DMDAAC:acrylic acid and has a molecular weight of approximately 1,000,000.

The total quantity of conditioning polymer containing cationic monomer units in the colour developer suitably ranges from 0 to about 5 wt %, preferably from about 0.1 to about 1 wt %, more preferably from about 0.2 to about 0.5 wt % by weight based on the total weight of the colour developer.

Most preferably the colour developer comprises from 0.2 to 0.5 wt % of a copolymer of DMDAAC and acrylic acid, by weight based on the total weight of the composition.

Another preferred ingredient for inclusion in the colour developer is a hydrocarbon emollient. Particularly preferred are petroleum-derived hydrocarbon emollients, which may be characterised as purified hydrocarbons or mixtures of hydrocarbons obtained from petroleum and having chain lengths of from about C10 to about C100. Petroleum-derived hydrocarbon emollients within this chain length range include mineral oil and petrolatum. Mineral oils are clear oily liquids obtained from petroleum oil, from which waxes have been removed, and the more volatile fractions removed by distillation. The fraction distilling between 250° C. to 300° C. is termed mineral oil, and it consists of a mixture of saturated hydrocarbons, in which the number of carbon atoms per hydrocarbon molecule generally ranges from about 10 to about 40. Petrolatum is the most preferred hydrocarbon emollient for inclusion in the second composition of the kit. Also known as petroleum jelly or mineral jelly, petrolatum may be generally characterised as a white to yellow homogeneous colloidal mixture of solid and high-boiling liquid hydrocarbons obtained from petroleum, with melting points typically ranging from about 35° to about 60° C. and molecular masses ranging from about 450 to about 1000. Its chief constituents are alicyclic hydrocarbons and straight or branched chain aliphatic hydrocarbons having from about 16 to about 40 carbon atoms.

The total quantity of hydrocarbon emollient in the colour developer suitably ranges from 0.1 to about 10 wt %, preferably from about 0.5 to about 7 wt %, more preferably from about 1 to about 4 wt % by weight based on the total weight of the colour developer.

Most preferably the colour developer comprises from 1 to 4 wt % petrolatum, by weight based on the total weight of the colour developer.

The pH of the colour developer is typically acidic, and generally the pH is from 2.5 to 6.5, preferably from 3 to 5. The pH of the colour developer may be adjusted using a pH modifier.

Other conventionally used adjuvants which may be usefully incorporated into the colour developer for enhancing performance and/or consumer acceptability include peroxide stabilisers; fragrances or perfume oils; chelating agents; opacifying agents; buffers; dispersing agents; sequestering agents; humectants; and antimicrobials.

The hair colorant part suitably comprises one or more oxidative dye precursors that are operable, when combined with an aqueous oxidizing agent, to impart colour to the hair. Generally such oxidative dye precursors include primary intermediates and optionally couplers for the formation of oxidative dyes. Primary intermediates yield colour on oxidation. Couplers do not form dyes on oxidation but do produce colour changes when used with primary intermediates.

Primary intermediates mainly belong to three classes of aromatic compounds: diamines, aminophenols and phenols. Examples include ortho- or para-substituted aminophenols or phenylenediamines and cosmetically acceptable salts thereof. Particularly preferred primary intermediates include: p-phenylenediamine; p-toluenediamine; p-aminophenol; 3-methyl-p-aminophenol; N,N-bis(2-hydroxyethyl)-p-phenylenediamine; 2-hydroxyethyl-p-phenylenediamine; 1-hydroxyethyl-4,5-diaminopyrazole; and cosmetically acceptable salts thereof and combinations thereof. Primary intermediates are generally used in approximately equimolar quantities with respect to couplers, for example at a molar ratio of primary intermediate to coupler from 0.95 to 1.05, although the relative quantities may vary depending upon the formulation and the desired colour, intensity or effect.

Couplers are generally meta-derivatives such as phenol, resorcinol and naphthol derivatives, m-aminophenols and m-phenylenediamines; which may be unsubstituted, or substituted on the amino group or benzene ring with alkyl, hydroxyalkyl or alkylamino groups. Particularly preferred couplers include: resorcinol; 4-chlororesorcinol; m-aminophenol; 1-naphthol; 4-amino-2-hydroxytoluene; 2-methyl-5-hydroxyethylaminophenol; 2,4-diaminophenoxyethanol; 2-methylresorcinol; bis(2,4-diaminophenoxy)-1,3-propane; 2-amino-4-hydroxyethylaminoanisole; 2-amino-3-hydroxypyridine; 1-acetoxy-2-methylnaphthalene; and cosmetically acceptable salts thereof and combinations thereof.

The total quantity of oxidative dye precursor(s) generally ranges from about 0.01 to about 15 wt %, by total weight primary intermediate(s) and optionally coupler(s), based on the total weight of the hair colorant part.

The hair colorant part will usually be formulated into a cosmetic preparation such as a solution, cream, lotion, gel or emulsion, and so will generally contain other components commonly associated with the formulation of such products.

For example, surfactants may be used to help dissolve the primary intermediates and couplers, to assist in spreading the dye evenly over the hair, and to thicken the product. Suitable surfactants include anionic or nonionic surfactants, such as sulfates of fatty alcohols, alkanolamides of fatty alcohols, alkyl sulfonates, alkylbenzene sulfonates, oxyethylated fatty alcohols, oxyethylated nonylphenols and mixtures thereof.

If formulated as a lotion, the hair colorant part may contain organic solvents to assist in dissolving the primary intermediates and couplers. The organic solvent content of such a lotion may be up to about 20 wt %, and preferably ranges from about 1 to about 15 wt %, by weight based on the total weight of the composition. Examples of suitable organic solvents in this context include alcohols containing up to three carbon atoms such as ethanol and isopropanol, polyhydroxy alcohols such as propylene or hexylene glycol and their lower ($C_1$-$C_4$) alkyl ethers, such as ethoxy ethers.

Depending on the final formulated preparation, the hair colorant part may be weakly acidic, neutral or alkaline. Preferred is a pH range of about 8 to 11. Any of a wide variety of alkaline reagents can be used to adjust the pH of the hair colorant part. Such alkaline reagents include ammonium hydroxide, sodium, potassium or calcium hydroxide, sodium or potassium carbonate, sodium phosphate, sodium silicate, guanidine hydroxide, or any one of the alkylamines or alkanolamines, for example, ethylamine, triethylamine, trihydroxymethylamine, ethanolamine, diethanolamine, aminomethyl propanol, aminomethyl propanediol and the like.

Other conventionally used adjuvants which may be usefully incorporated into the hair colorant part for enhancing performance and/or consumer acceptability include antioxidants to inhibit premature oxidation of oxidative colorant by air (e.g. ascorbic acid, erythorbic acid, or sodium sulfite); fragrances or perfume oils; chelating agents; opacifying agents; buffers; dispersing agents; sequestering agents; humectants; and antimicrobials.

One or a mixture of any of the above adjuvants may be incorporated in the hair colorant part, in concentrations suitably ranging from about 0.001 to about 7.5 wt %, by weight of the individual adjuvant based on the total weight of the hair colorant part.

Preferably the hair colorant part is packaged in a pliable tube made of an air-impermeable material such as aluminium.

In order to colour the hair, the colour developer and the hair colorant part are mixed together, usually shortly before use. Preferably the container according to the invention also serves as the mixing receptacle for the colour developer and the hair colorant part.

Preferably the colour developer and the hair colorant part are mixed at a weight ratio ranging from 1:2 to 2:1, more preferably at a weight ratio ranging from 3:2 to 2:3, ideally around 1:1.

Preferably when the colour developer and the hair colorant part are mixed at the weight ratio defined above (more preferably at a weight ratio ranging from 1:2 to 2:1 and most preferably at a weight ratio ranging from 3:2 to 2:3, ideally around 1:1) the resulting mix has a yield stress from 85 to 125 and more preferably from 90 to 110 Pa; and a viscosity from 0.15 to 0.4 Pa·s and more preferably from 0.2 to 0.35 Pa·s at 25° C.

BRIEF DESCRIPTION OF THE DRAWINGS

A specific embodiment of a container according to the invention will now be illustrated with reference to the accompanying drawings, in which.

DETAILED DESCRIPTION OF THE PREFERRED EMBODIMENT

Figure 1A:
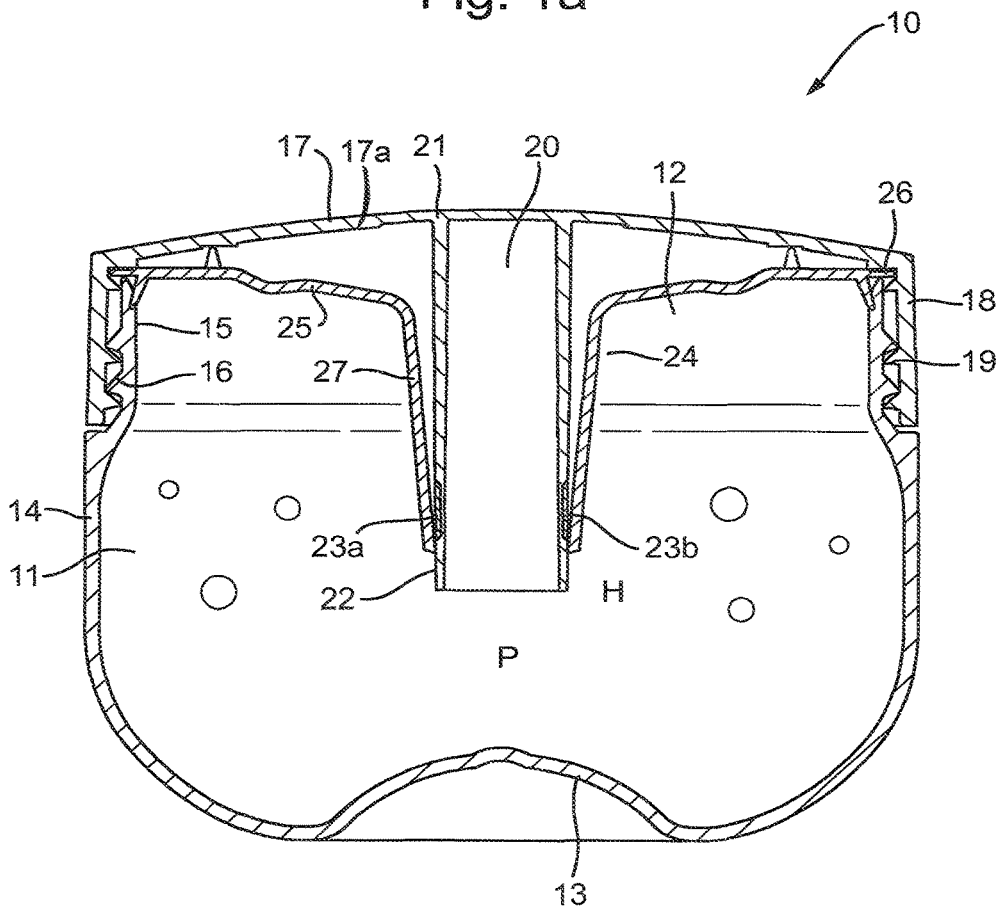
FIG. 1*a* represents a schematic cross-sectional view of a container according to the invention in the closed position.

Referring to FIG. 1*a*, generally cylindrical container 10 comprises a plastic container body 11 and a removable plastic lid 12 for closing the container body 11.

The container body 11 comprises a container base 13 with a slightly concave surface and a container wall 14 extending from the container base 13 and surrounding and enclosing an interior volume of the container body 11. The interior volume of the container body 11 has a geometric centre that is generally equidistant from opposite points of the container wall 14. The container wall 14 has an annular upper portion 15 defining the mouth of the container body 11 and bearing a threaded surface 16.

The removable lid 12 comprises a top portion 17 and a depending skirt portion 18 bearing a threaded surface 19 configured for engagement with corresponding threaded surface 16 on the mouth of the container body 11.

The top portion 17 of removable lid 12 has an inner surface 17*a* provided with a hollow venting tube 20. The hollow venting tube 20 has an upper end 21 in sealed contact with inner surface 17*a* and a lower end 22 bearing vent slots 23*a*, 23*b*. Hollow venting tube 20 is disposed centrally in three dimensions within the interior volume of container body 11.

Hollow venting tube 20 is shrouded by resilient flexible plastic liner 24. Liner 24 has a disc shaped portion 25 with a circumferential edge 26 adapted for engagement with inner surface 17*a* and a tubular portion 27 extending from disc shaped portion 25.

In the closed position as shown in FIG. 1*a*, tubular portion 27 of venting tube liner 24 covers vent slots 23*a*, 23*b* in hollow venting tube 20.

Figure 1B:
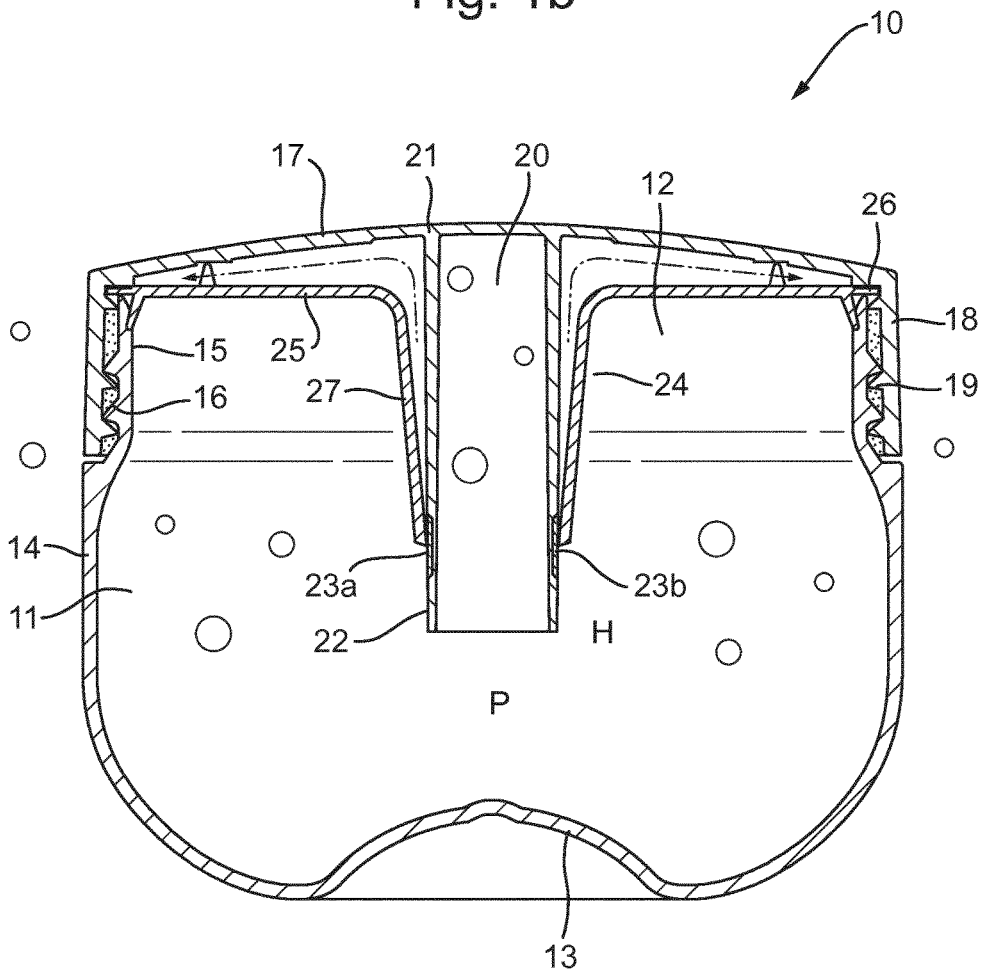
FIG. 1*b* represents a schematic cross-sectional view of the same container in the venting position.

In the venting position as shown in FIG. 1*b*, tubular portion 27 of venting tube liner 24 exposes vent slots 23*a*, 23*b* in hollow venting tube 20.

In use, the interior volume of the container body 11 is partially filled with a fluent product P which off-gases, with vent slots 23*a*, 23*b* of hollow venting tube 20 positioned in the head space H of the product P.

As pressure from accumulated gas builds in the head space H, liner 24 flexes into the venting position. Eventually, exposure of vent slots 23*a*, 23*b* enables accumulated gas to exit container body 11 via a passageway between threaded surfaces 16 and 19. Liner 24 reverts to the closed position upon release of the excessive pressure, thus effecting periodic venting of the container body.

The invention claimed is:

1. A container for the packaging of a fluent product which off-gases, the container comprising:

a container body for receiving and storing product, the container body comprising a container base, a mouth, and a container wall extending from the base, the wall having an upper portion defining the mouth of the container body and bearing a threaded surface and a removable lid for closing the container body, the removable lid comprising a too portion and a depending skirt portion; the depending skirt portion bearing a threaded surface configured for engagement with a corresponding threaded surface of the mouth of the container body;

wherein the removable lid is provided with a venting assembly extending into the container body, the venting assembly having a closed position which is effective to close the container body and a venting position permitting the venting of gas from the container body, the venting assembly comprising:

a hollow venting tube provided on an inner surface of the too portion of the lid and configured such that it extends into the interior of the container body when then lid is engaged with the body, the hollow venting tube having an upper end in sealed contact with the inner surface of the top portion of the lid and a lower end bearing one or more apertures for the intake of accumulated gas;

a venting tube liner of resilient flexible materials having a disc shaped portion with a circumferential edge adapted for engagement with an inner surface of the lid; and at least one tubular portion extending from the disc shaped portion and configured such that it shrouds the hollow venting tube when the venting tube liner is engaged with the lid;

wherein the venting tube liner is movable from a closed position, covering the one or more apertures in the hollow venting tube and effective to close the container body, to a venting position exposing the one or more apertures in the hollow venting tube and permitting venting of gas from the container body whereby when the container body is partially filled with a fluent product which off-gases, the venting tube liner moves to the venting position in response to excessive pressure from accumulated gas, and reverts to the closed position upon release of the excessive pressure, thus effecting periodic venting of the container body; and whereby the spatial arrangement of the hollow venting tube within the container body provides for venting of the container body independently of the orientation of the container, whilst retaining the product within the container body.

2. The container according to claim 1, in which the container wall surrounds and encloses an interior volume of the container body, and includes a peripheral section disposed at least a minimum radius r from a first axis within the interior volume and a pair of end sections disposed generally transverse to the first axis and joined peripherally to the peripheral sections; and the venting assembly extends along the first axis; the end sections of the container wall each being separated from the one or more apertures of the hollow venting tube along the first axis by a distance h; such that when the interior volume is partially filled with product, the product has a depth of less than h when the first axis is disposed vertically and less than r when the first axis is disposed horizontally.

3. The container according to claim 1, in which the container wall surrounds and encloses an interior volume of the container body having a geometric centre that is generally equidistant from opposite points of the container wall, and the venting assembly is disposed centrally in three dimensions within the interior volume; such that when the interior volume is partially filled with product, the one or more apertures of the hollow venting tube remain in the head space of the product regardless of the orientation of the container.

* * * * *